US008991422B2

(12) United States Patent
Risatti

(10) Patent No.: US 8,991,422 B2
(45) Date of Patent: Mar. 31, 2015

(54) RETURN DIFFUSER FOR HYDRAULIC TANK

(75) Inventor: Bruno Lawrence Risatti, Lemont, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 13/547,257

(22) Filed: Jul. 12, 2012

(65) Prior Publication Data

US 2014/0014215 A1 Jan. 16, 2014

(51) Int. Cl.
*F15B 1/26* (2006.01)
*F15B 21/04* (2006.01)

(52) U.S. Cl.
CPC ..... *F15B 1/26* (2013.01); *F15B 21/044* (2013.01); *F15B 21/047* (2013.01)
USPC ..... 137/592; 137/561 A; 137/563; 137/550; 60/454; 261/124

(58) Field of Classification Search
USPC ..... 137/561 A, 563, 592, 550; 60/453, 454; 261/124, 122.1, DIG. 70, 123, 77; 210/220
See application file for complete search history.

(56) References Cited

U.S. PATENT DOCUMENTS 2,242,807 A * 5/1941 Austin ..... 210/422
3,198,376 A 8/1965 Ashley
3,225,543 A 12/1965 Vivier
3,682,197 A * 8/1972 Snyder ..... 137/590
3,847,243 A 11/1974 Barth
3,847,805 A * 11/1974 Voedisch ..... 210/675
3,976,124 A 8/1976 Brown
4,098,695 A * 7/1978 Novotny ..... 210/85
4,127,143 A 11/1978 Zinga
4,343,697 A 8/1982 Miller et al.
5,421,383 A 6/1995 Schmid
5,975,257 A * 11/1999 Roach ..... 188/264 F
6,783,334 B2 8/2004 Sanderson et al.
6,887,376 B2 5/2005 Cella et al.
7,008,536 B2 * 3/2006 Varadaraj et al. ..... 210/243
7,886,768 B2 2/2011 Kobayashi et al.

FOREIGN PATENT DOCUMENTS

CN 201472152 5/2000
DE 102007012527 A1 9/2008
JP 2000 205208 A 7/2000

* cited by examiner

*Primary Examiner* — Atif Chaudry
(74) *Attorney, Agent, or Firm* — Miller, Matthias & Hull LLP

(57) ABSTRACT

A diffuser assembly for a hydraulic reservoir is disclosed. The diffuser assembly includes an inlet tube for connection to the inlet to the reservoir. A middle portion of the middle tube is connected to a plurality of diffusers. The diffusers are disposed at an angle with respect to an axis of the inlet tube and the axis of the inlet to the reservoir so that fluid flowing into the reservoir must change flow directions for entering and exiting the diffusers. The disclosed diffuser assembly is less prone to damaged cause by fluid flow spikes and is particularly useful for high flow/high pressure applications.

16 Claims, 2 Drawing Sheets

RETURN DIFFUSER FOR HYDRAULIC TANK

BACKGROUND

1. Technical Field

This disclosure relates generally to hydraulic systems and, more specifically, to return or inlet lines to a hydraulic tank or reservoir that are equipped with diffusers. The diffusers are used to control the delivery of high velocity hydraulic fluid that is returned to the tank.

2. Description of the Related Art

Fixed and/or variable positive displacement hydraulic pumps have numerous applications in many fields, including automotive, aerospace, industrial, agricultural, heavy equipment and the like for performing work. In a typical hydraulic system, return fluid is simply returned into the pump reservoir where it dwells for time period before being drawn in by the inlet to the pump for recirculation. Under conditions of high load and high flow rate, such hydraulic systems may be unable to keep up with the fluid demand of the pump, leading to cavitation and unacceptable levels of noise. Another inherent disadvantage with such systems is that the kinetic energy of the incoming fluid to the reservoir is lost and not utilized to feed the inlet to the pump, leading to relatively low efficiencies.

Specifically, hydraulic fluid or oil in such a system is moving at a high velocity when it is returned to the tank. The high velocity flow rates result in considerable amounts of turbulence. The turbulence has many undesirable effects, such as causing cavitation in the hydraulic circuit. Another undesirable effect is that the turbulence causes fluid to be lost through the reservoir air vent. This results in permanent loss of the fluid and causes the fluid to coat the exterior of the equipment, creating safety and cleanliness problems.

In the past, hydraulic tanks have been provided with baffles and the direction of discharge has been varied in an attempt to correct the above problems. However, baffles are not preferable because they consume space in the tank and limit the design possibilities for the tank. More recently, the inlet lines to hydraulic tanks had been equipped with a diffuser for reducing the velocity and turbulence of the hydraulic fluid being returned to the tank. The use of a diffuser may also eliminate the need for one or more baffles.

The use of a diffuser for hydraulic high-speed return lines to slow down the fluid entering the tank is shown, for example, in U.S. Pat. No. 4,127,143, which discloses a frustoconically shaped diffuser having an internal diameter that expands as it enters the tank. However, the '143 patent also relies upon a baffle between the tank inlet and the outlet. Many currently available diffusers are essentially screen-like axial extensions to the inlet and the screen may deaerate the fluid as well as reduce the velocity of the fluid thereby reducing turbulence and foaming. Currently available diffusers may also trap particles that are present in the returning fluid which may help protect the downstream components, such as the pump.

However, currently available return diffusers for hydraulic tanks are subject to damage when the pressure of the returning fluid spikes. This problem is particularly prevalent in high velocity/high-pressure applications. Therefore, there is a need for improved return lines and diffusers for hydraulic tanks that effectively reduce the velocity of the returning fluid, deaerate the fluid, reduce the turbulence and foaming of the fluid as well as remove particulate matter from the fluid, but which are less prone to damage resulting from fluid flow or pressure spikes.

SUMMARY OF THE DISCLOSURE

In one aspect, a diffuser assembly for a hydraulic reservoir is disclosed. The diffuser assembly may include an inlet tube having a proximal end for receiving hydraulic fluid and a closed distal end with a middle portion disposed between the proximal and distal ends. The inlet tube may also include an inlet axis. The middle portion of the inlet tube may be connected to first and second diffusers for communicating fluid from the inlet tube to the reservoir. The first and second diffusers may each include a conduit having a proximal end connected to the middle portion of the inlet tube and a closed distal end with a plurality of openings disposed between the proximal and distal ends. The first and second diffusers may each further include first and second diffuser axes respectively. The first and second diffuser axes may be disposed at angles relative to the inlet axis ranging from about 60° to about 120°.

In another aspect, a hydraulic fluid reservoir is disclosed. The disclosed hydraulic fluid reservoir may include a chamber for containing hydraulic fluid. The reservoir may also include an outlet and an inlet. The inlet may be connected to a proximal end of an inlet tube. The inlet tube may include a closed distal end with a middle portion disposed between the proximal and distal ends. The inlet tube may also include an inlet axis. The middle portion of the inlet tube may be connected to first and second diffusers for communicating fluid from the inlet tube to the internal chamber. The first and second diffusers may each include a conduit having a proximal end connected to the middle portion of the inlet tube and a closed distal end with a plurality of openings disposed between the proximal and distal ends. The first and second diffusers may each further include first and second diffuser axes respectively. The first and second diffuser axes may be disposed at angles relative to the inlet axis ranging from about 60° to about 120°.

In yet another aspect, a hydraulic system is disclosed. The disclosed hydraulic system may include a reservoir that may include a chamber for containing hydraulic fluid. The reservoir may also include an inlet and an outlet. The inlet may be in communication with a proximal end of an inlet tube. The inlet may also be in communication with a work implement. The outlet may be in communication with a pump. The pump may be in communication with the work implement. The inlet tube may also include a closed distal end with the middle portion disposed between the proximal and distal ends of the inlet tube. The middle portion of the inlet tube may be connected to first and second diffusers for communicating fluid from the inlet tube to the internal chamber. The first and second diffusers may each include a conduit having a proximal end connected to the middle portion of the inlet tube and a closed distal end with a plurality of openings disposed between the proximal and distal ends of the conduits. The first and second diffusers may each further include first and second diffuser axes respectively. The first and second diffuser axes may be disposed at angles relative to the inlet axis ranging from about 60° to about 120°.

Finally, in yet another aspect, a method of circulating hydraulic fluid through a hydraulic system is disclosed. The disclosed method may include providing a hydraulic system as discussed above, pumping hydraulic fluid from the reservoir chamber through the pump and through the work implement to the inlet tube, and flowing the hydraulic fluid from the inlet tube through the first and second diffusers to the chamber.

In any one or more of the embodiments described above, the first and second diffusers may be spaced apart from each other.

In any one or more of the embodiments described above, the first and second diffusers may be disposed at least substantially parallel to one another.

In any one or more of the embodiments described above, the first and second diffuser axes are at least substantially perpendicular to the inlet axis.

In any one or more of the embodiments described above, the reservoir chamber may be free of baffles.

Regarding the disclosed method, the method may further include trapping particles entrained in the at least one of the first and second diffusers as the hydraulic fluid flows from the inlet tube through the first and second diffusers to the chamber.

Other advantages and features will be apparent from the following detailed description when read in conjunction with the attached drawings.

DETAILED DESCRIPTION OF THE PRESENTLY PREFERRED EMBODIMENTS

Figure 1:
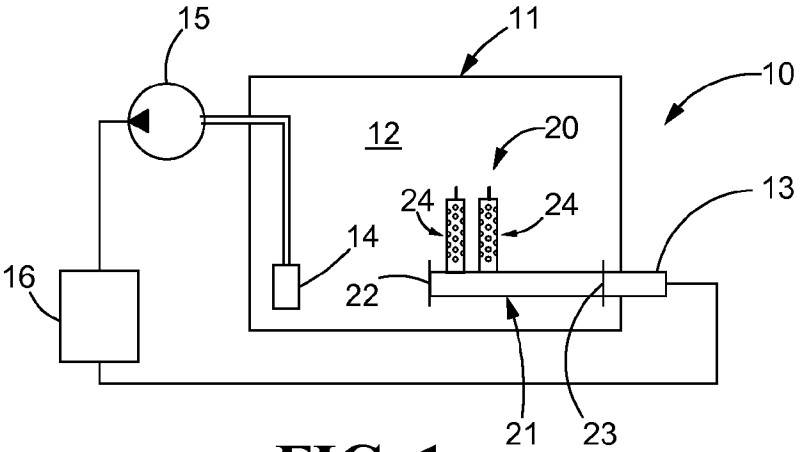
FIG. 1. is a schematic illustration of a hydraulic circuit that incorporates the disclosed diffuser assembly.
Figure 2:
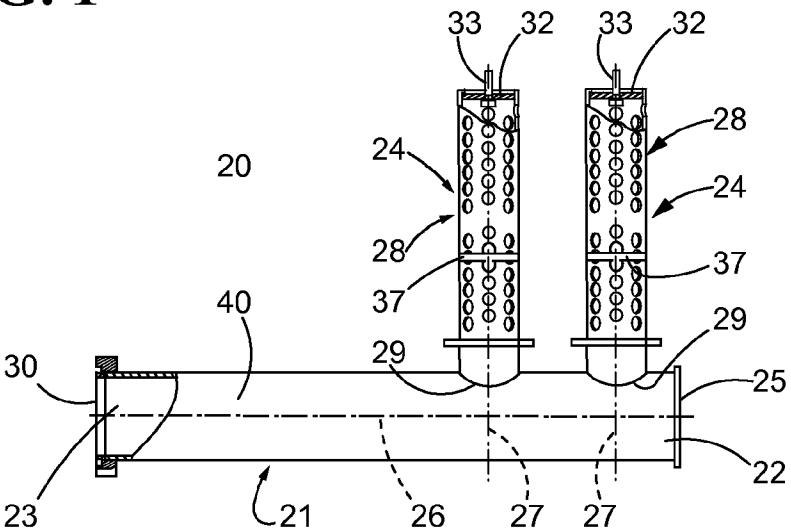
FIG. 2 is a plan view of the disclosed diffuser assembly.

Turning first to FIG. 1, a hydraulic circuit 10 is disclosed which may include a tank or reservoir 11 that may include an interior chamber 12 for containing hydraulic fluid or oil. The reservoir 11 may also include an inlet 13 and an outlet 14. The outlet 14 may optionally include a filtering element (not shown) and may be in communication with a pump 15. The pump 15, in turn, may be in communication with a work implement 16. The work implement 16 may then be in communication with the inlet 13 where hydraulic fluid is returned to the chamber 12 through the diffuser assembly 20. The diffuser assembly 20 may include an inlet tube 21 having a proximal end 23 coupled to the reservoir inlet 13 and a closed distal end 22. The inlet tube may be coupled to a plurality of diffusers 24, which are shown in greater detail in connection with FIGS. 2-4. While only two diffusers 24 are shown in FIGS. 1-2, more than two diffusers 24 may be utilized. The number of diffusers 24 may depend upon the desired flow characteristics, flow attenuation, sound reduction, etc. as will be discussed below in connection with FIG. 2.

Figure 3:
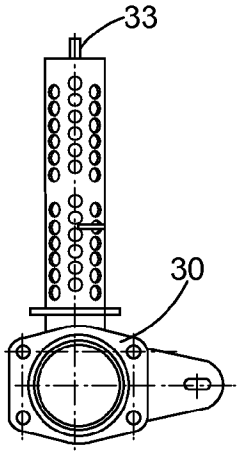
FIG. 3 is an end view of the diffuser assembly shown in FIG. 2.
Figure 4:
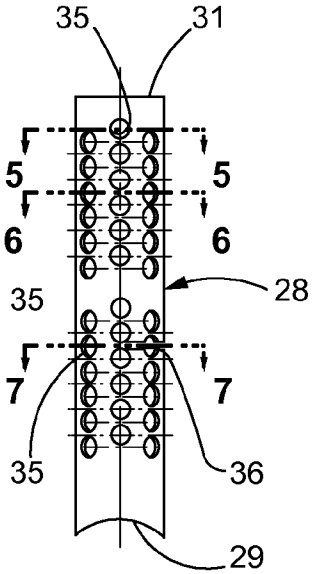
FIG. 4 is a plan view of one of the diffuser conduits of the diffusers of the diffuser assembly shown in FIG. 2.

Turning to FIG. 2, the distal end 22 of the inlet tube 21 may be closed using a plate 25 while the proximal end 23 may be coupled to the inlet 13 using the bracket 30 as shown in FIG. 3. FIG. 2 also illustrates the connection between the inlet tube 21 and the diffusers 24. In the example shown in FIG. 2, the diffusers 24 are disposed perpendicular to the inlet tube 21 or perpendicular to the inlet axis 26. More specifically, the diffusers 24 may each include a diffuser axis 27. In the example shown in FIG. 2, the diffuser axes 27 are perpendicular to the inlet axis 26 and parallel to each other. However, the relative angles between the axes 27 and the axis 26 may vary and may range from about 60° to about 120°. As explained below, the axes 27 may also have a non-parallel relationship with respect to each other. As shown in FIGS. 2 and 4, each diffuser 24 includes a conduit 28. Each conduit 28 includes a proximal end 29 and a distal end 31. The proximal ends 29 are curved so that they may be welded to holes or apertures drilled into the inlet tube 21 as shown in FIG. 2. The distal ends 31 of the conduits 28 may also be enclosed by a plate 32 which optionally may be equipped with a pressure release valve 33.

Figure 5:
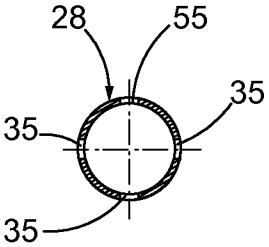
FIG. 5 is a sectional view taken substantially along line 5-5 of FIG. 4.
Figure 6:
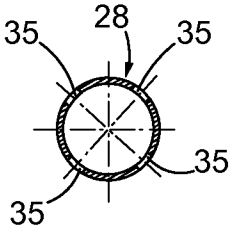
FIG. 6 is a sectional view taken substantially along line 6-6 of FIG. 4
Figure 7:
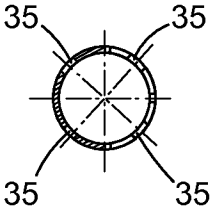
FIG. 7 is a sectional view taken substantially along line 7-7 of FIG. 4.

The conduits 28 may be screens or perforated tubes as shown in FIGS. 2-4. In the example shown, the diffuser conduits 28 include a plurality of holes 35. As shown in the sectional views of FIGS. 5-7, the holes 35 are arranged in columns and staggered rows as each row of holes 35 includes four holes 35. Each conduit 28 may also include a slot 36 (FIG. 4) for accommodating a plate 37 that contributes to the reduction in the velocity of the hydraulic fluid flowing through the diffusers 24. In addition to reducing the velocity of the hydraulic fluid flowing through the holes 35 of the conduits 28, the holes 35 may also act as a filter by trapping particles entrained in the returning hydraulic fluid which may help protect downstream components such as the pump 15 or work implement 16 from damage.

Returning to FIG. 2, the axes 27 of the diffusers 24 are shown in a parallel relationship with respect to each other. However, because the diffuser conduits 28 may vary in terms of the configurations, positions and number of the holes 35, the effect the diffusers 24 have on the fluid flowing into the reservoir 11 can vary widely and therefore other orientations of the diffusers 24 are possible. Thus, the diffusers 24 may be positioned in a non-parallel relationship to one another. Further, FIG. 2 also shows the axes 27 of the diffusers 24 in a perpendicular relationship to the axis 26 of the inlet tube 21. Again, because the design of the diffusers 24 may vary widely, which will affect the flow characteristics, sound and flow attenuation properties, the diffusers 24 may be disposed in a non-perpendicular relationship to the axis 26 as discussed above.

Further, the FIG. 2 shows the diffusers 24 disposed towards the distal end 22 of the inlet tube 21, which creates a volume chamber 40 between the diffusers 24 and the proximal end 23 of the inlet tube 21. In addition to variations in the design of the diffusers 24, the size of the volume chamber 40 may also affect the volume of the sound created by fluid flowing through the diffusers 24, the attenuation of the fluid flowing through the diffuser assembly 20 as well as the flow characteristics of the fluid flowing through the diffuser assembly 20. Thus, moving the diffusers 24 towards or away from the proximal end 23 is one way in which the diffuser assembly 20 can be "tuned" to achieve the desired effects on the fluid flowing through the diffuser assembly 20. Again, in addition to the spacing of the diffusers 24 along the inlet tube 21, the angular relationships between the diffuser axes 27 and between the diffuser axes 27 and the axis 26 of the inlet tube 21 may also be used to tune the diffuser assembly 20 to achieve the desired effects on the fluid flowing through the diffuser assembly 20.

Figure 8:
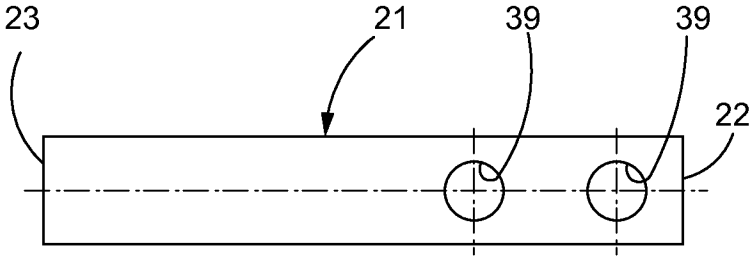
FIG. 8 is a top plan view of the inlet tube of the diffuser assembly shown in FIG. 2.
Figure 9:
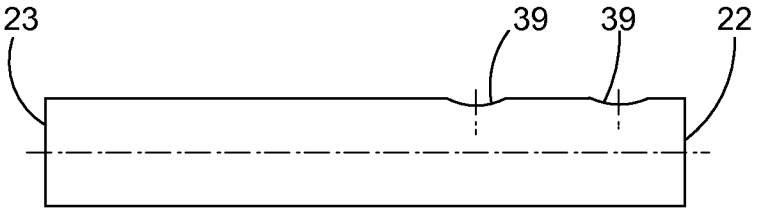
FIG. 9 is a side plan view of the inlet tube shown in FIG. 8.

FIGS. 8 and 9 illustrate the inlet tube 21 which may include a pair of holes 39 that receive the proximal ends 29 of the diffuser conduits 28 as explained above. Again, the spacing of the holes 39 along the inlet tube 21 may be varied in the position of the holes 39 with respect to each other may be varied so that the axes 27 are not necessarily parallel. In summary, while the parallel relationship between the axes 27 and the perpendicular relationships between the axes 27 and the axis 26 provide good flow attenuation, good reduction in the fluid flow velocity through the diffusers 24, good reduction in turbulence, reduced noise, etc., the parallel and perpendicular relationships shown in the drawings may be altered, particularly if the design of the diffuser conduits 28 is changed.

INDUSTRIAL APPLICABILITY

Currently available prior art return diffusers typically include a single screen cylinder or tube that is coaxial with the reservoir inlet. However, this common arrangement is subject to damage when the amount of hydraulic fluid being returned to the reservoir or tank spikes. This, of course, is problematic as the hydraulic circuit must be shut down and the inlet and diffuser must be removed for repairs. To overcome this problem, a diffuser assembly is disclosed wherein an inlet tube is provided that is coaxial with the inlet of the reservoir. A plurality of diffusers, such as a pair of diffusers are spaced apart along the inlet tube and are disposed at an angle with respect to the axis of the inlet tube. Preferably, the diffusers are disposed at angles ranging from about 60° to about 120° with respect to the axis of the inlet tube. One convenient arrangement is to attach the diffusers to the inlet tube at right angles to the inlet tube axis. However, other angles within the stated range may be employed. Surprisingly, by increasing the diffusers from a single diffuser to a plurality of diffusers and by positioning the diffusers at an angle that is not coaxial with the inlet to the reservoir, damage to the diffusers from fluid flow spikes is avoided. Further, the disclosed diffuser assembly does not require a separate baffle within the reservoir, although one or more baffles may be employed. Thus, the elimination of the need for baffles is obtained by the disclosed diffuser assembly and the disclosed diffuser assembly is more durable and less prone to damage from fluid flow spikes.

What is claimed:

1. A hydraulic fluid reservoir comprising:

a chamber for containing hydraulic fluid, the chamber including a horizontal bottom, a top and at least one sidewall connecting the horizontal bottom to the top, the chamber including an outlet and an inlet, the inlet passing through the at least one sidewall and being connected to a proximal end of a horizontal inlet tube disposed inside the chamber and parallel to the horizontal bottom of the chamber, the inlet also being in communication with a work implement, the outlet being in communication with a pump, the pump being in communication with the work implement;

the horizontal inlet tube also including a closed distal end with a middle portion disposed between the proximal and closed distal ends, the horizontal inlet tube having a horizontal inlet axis;

the middle portion of the horizontal inlet tube connected to first and second upwardly directed diffusers for communicating fluid from the horizontal inlet tube to the chamber, the first and second upwardly directed diffusers each including a proximal end connected to the middle portion of the horizontal inlet tube, a closed distal end and a cylindrical conduit connecting the proximal and closed distal ends, the cylindrical conduit including a plurality of openings disposed between the proximal and closed distal ends, the first upwardly directed diffuser including a first upwardly directed diffuser axis, the second upwardly directed diffuser including a second upwardly directed diffuser axis, the first and second upwardly directed diffuser axes being disposed at upwardly directed angles relative to the horizontal inlet axis ranging from about 60° to about 85° or from about 95° to about 120°.

2. The hydraulic reservoir of claim 1 wherein the first and second upwardly directed diffusers are spaced apart from each other.

3. The hydraulic reservoir of claim 1 wherein the first and second upwardly directed diffusers are disposed at least substantially parallel to one another.

4. The hydraulic reservoir of claim 3 wherein the first and second upwardly directed diffuser axes are disposed at least substantially perpendicular to the inlet axis.

5. The hydraulic reservoir of claim 1 wherein the first and second upwardly directed diffuser axes are disposed at least substantially perpendicular to the inlet axis.

6. A hydraulic system comprising:

a reservoir including a chamber for containing hydraulic fluid, the chamber including a horizontal bottom, a top and at least one sidewall connecting the horizontal bottom to the top, the chamber also including an outlet and an inlet, the inlet passing through the at least one sidewall and being in communication with a proximal end of a horizontal inlet tube disposed inside the chamber and parallel to the horizontal bottom, the inlet also being in communication with a work implement, the outlet being in communication with a pump, the pump being in communication with the work implement;

the horizontal inlet tube also including a closed distal end with a middle portion disposed between the closed distal end and the proximal end, the horizontal inlet tube having a horizontal inlet axis;

the middle portion of the horizontal inlet tube being connected to first and second upwardly directed diffusers for communicating fluid from the horizontal inlet tube to the chamber, the first and second upwardly directed diffusers each including a cylindrical conduit having a proximal end connected to the middle portion of the horizontal inlet tube and a closed distal end with a plurality of openings disposed therebetween, the first upwardly directed diffuser including a first upwardly directed diffuser axis, the second upwardly directed diffuser including a second upwardly directed diffuser axis, the first and second upwardly directed diffuser axes being disposed at angles relative to the horizontal inlet axis ranging from about 60° to about 120°, the cylindrical conduit of the first upwardly directed diffuser further including a slot and a plate disposed in the slot, the slot disposed between the proximal end and the closed distal end of the cylindrical conduit of the first upwardly directed diffuser.

7. The hydraulic system of claim 6 wherein the first and second upwardly directed diffusers are spaced apart from each other along the inlet tube.

8. The hydraulic system of claim 6 wherein the first and second upwardly directed diffusers are disposed at least substantially parallel to one another.

9. The hydraulic system of claim 8 wherein the first and second upwardly directed diffuser axes are disposed at least substantially perpendicular to the inlet axis.

10. The hydraulic system of claim 6 wherein the first and second upwardly directed diffuser axes are disposed at least substantially perpendicular to the inlet axis.

11. A method of circulating hydraulic fluid through a hydraulic system, the method comprising:

providing a hydraulic system in accordance with claim 6;

pumping hydraulic fluid from the chamber through the pump and through the work implement to the horizontal inlet tube; and flowing the hydraulic fluid from the horizontal inlet tube through the first and second upwardly directed diffusers to the chamber.

12. The method of claim 11 wherein the first and second upwardly directed diffusers are spaced apart from each other along the inlet tube.

13. The method of claim 11 wherein the first and second upwardly directed diffusers are disposed at least substantially parallel to one another.

14. The method of claim 13 wherein the first and second upwardly directed diffuser axes are disposed at least substantially perpendicular to the horizontal inlet axis.

15. The method of claim 11 wherein the first and second upwardly directed diffuser axes are at least substantially perpendicular to the horizontal inlet axis.

16. The method of claim 11 further including trapping particles entrained in the hydraulic fluid in at least one of the first and second upwardly directed diffusers as the hydraulic fluid flows from the horizontal inlet tube and through the first and second upwardly directed diffusers to the chamber.

* * * * *